United States Patent [19]

Lallinger

[11] 4,112,848

[45] Sep. 12, 1978

[54] WARHEAD CONSTRUCTION

[75] Inventor: Georg Lallinger, Muhlried, Germany

[73] Assignee: Messerschmitt-Bolkow-Blohm Gesellschaft mit Beschrankter Haftung, Munich, Germany

[21] Appl. No.: 86,282

[22] Filed: Nov. 2, 1970

[30] Foreign Application Priority Data

Nov. 6, 1969 [DE] Fed. Rep. of Germany ..... 1955777

[51] Int. Cl.[2] ..... F42B 13/50

[52] U.S. Cl. ..... 102/69; 102/7.2

[58] Field of Search ..... 102/7.2, 49.5, 58, 63, 102/68, 69

[56] References Cited

U.S. PATENT DOCUMENTS

| | | | |
|---|---|---|---|
| 48,005 | 5/1865 | Williams | 102/68 |
| 2,323,561 | 7/1943 | Newman | 102/63 |
| 3,295,444 | 1/1967 | Cushing et al. | 102/7.2 |
| 3,374,740 | 3/1968 | Voda | 102/49.5 |

*Primary Examiner*—Verlin R. Pendegrass

*Attorney, Agent, or Firm*—Toren, McGeady and Stanger

[57] ABSTRACT

A warhead for a device such as a missile, includes a plurality of explosive body or explosive charge assemblies arranged one behind the other in an axial direction and each assembly comprises a plurality of adjacent circumferentially arranged portions or segments which are arranged around one or more gas producing ejection cartridges. The warhead includes an outer casing or jacket which has a plurality of longitudinally extending breaking means, which are distributed around the circumference preferably to overlie the boundary lines between two adjacent charge portions of each assembly. The gas producing ejection cartridges are ignited by ignition means, for example, such as a time igniter in the head or nose of the warhead. After the cartridges are ignited they effect the breaking of the seams and the individual layers or segments of each explosive charge assembly move outwardly from the central ejection cartridge and pivot about their trailing ends which are mounted on plates without securement within the warhead jacket. The individual explosive body portions or segments are symmetrically spread by this action so that the individual explosive charge portions will move outwardly uniformly in both directions upon explosion.

12 Claims, 2 Drawing Figures

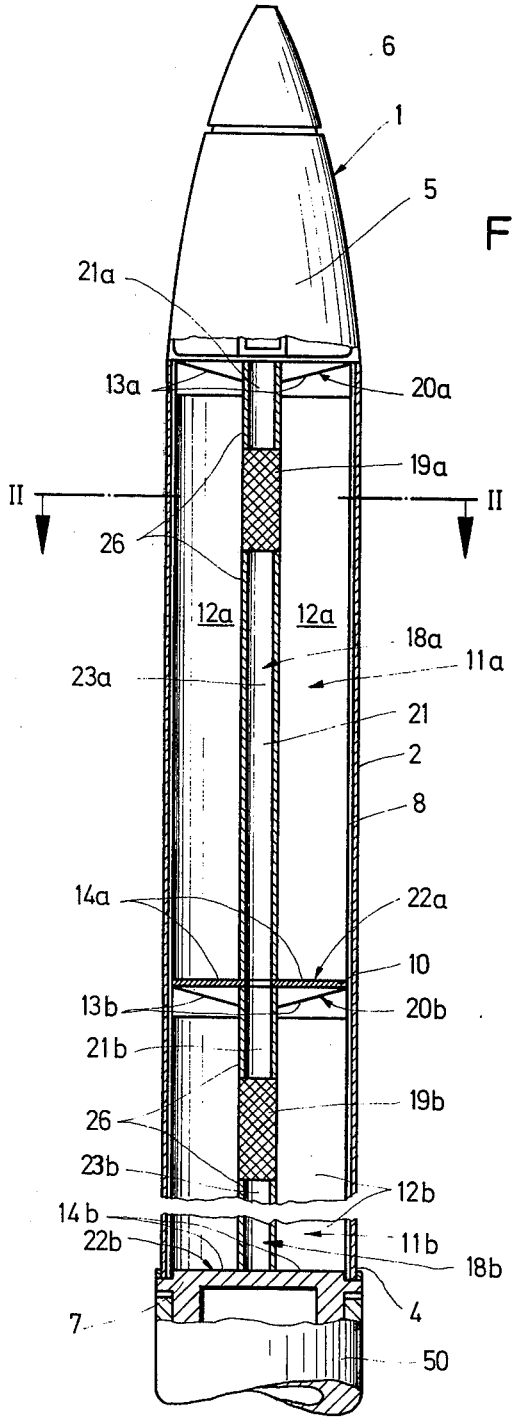
Fig.1
Fig.2
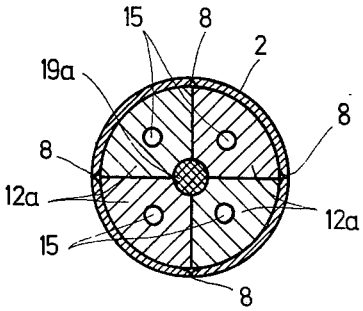
INVENTOR
Georg Lallinger
By
ATTORNEY

WARHEAD CONSTRUCTION

SUMMARY OF THE INVENTION

This invention relates in general to the construction of warheads and in particular, to a new and useful warhead made up of a plurality of assemblies of individual explosive charge portions and arranged one behind the other in an axial direction, the individual portions being spreadable outwardly upon ingition.

In the known embodiments of warheads of this kind, the explosive bodies of individual assemblies of explosive charges are arranged in a layerwise manner around a central tube or pipe and they are self-supporting. This tube or pipe includes on its exterior several breaking seams which extend longitudinally and which are uniformly distributed around the circumference at the exterior of the missile jacket. The prior art warhead construction also comprises decomposing charges which extend along the entire length of the breaking seams. In these constructions, the central tubes around which the explosive layers are positioned extend axially beyond termination of the breaking seams. Such tubes usually include an external thread and on this thread there is ecured a massive base plate. The next axially adjacent tube carries an exterior thread carrying a disk nut. The base plate and the disk nut serve primarily for fixing the explosive body layers in an axial direction and they include end faces which are facing the adjacent charge assembly which includes flanges which surround the adjacent explosive charge portion in a form fitting manner. These flanges together with the massive holding rings which bridge the impact areas between the individual explosive body layers on the exterior prevent the explosive bodies from moving in a radial outward direction until the time of the explosion of the decomposing charge.

The prior art devices have a disadvantage in respect to the relatively complicated construction required and the correspondingly high cost of manufacture. In addition, in order to obtain the desired symmetrical distribution or spreading of the explosive body particles in warheads of this kind, it is necessary in the prior art arrangement that upon separation of the breaking seams caused by explosion of the decomposition charge in the central tube, the base plate and the disk nut flange as well as the opposing rings and also the central tube have to be decomposed into equal parts. Of course, there are no breaking seams in the end regions. This does not occur. Rather the flanges in the holding ring separate or rip in an uncontrolled manner at any given area, namely, the weakest area so that there is no symmetrical distribution of the spreading of the explosive body particles.

In accordance with the invention, there is provided a warhead construction which is relatively simple and which includes an arrangement whereby there is a desirable symmetrical spreading or distribution of the explosive bodies upon explosion. The invention includes an outer casing or jacket which has longitudinally extending breaking seams which are distributed around its circumference in a uniform manner. Within the jacket are arranged a plurality of axially spaced assemblies of explosive bodies, each assembly including individual segmental shaped explosive body portions which are arranged around a central tube. One, or several, compression gas generating ejection cartridges are located at selected locations along the length of the tube or are separated by individual separate axial lengths of tubing. The arrangement is such that when the ejection cartridges are ignited, the gas pressure causes the breaking of the seams and the outward symmetrical movement of the individual explosive charge segments.

With the construction of the invention, due to the arrangement of the explosive charge assembly in the outer self-supporting jacket, it is unnecessary to provide the massive flanges and holding rings which are required in known constructions and which are necessary for fixing the explosive bodies in a radial direction and for fixing the central tube. By constructing the outer jacket with the circumferentially spaced axially extending breaking seams which are arranged uniformly around the circumference the jacket will not obstruct the symmetrical spreading of the explosive bodies. In addition, with the inventive device, the explosive seams are arranged to overlie the juncture between adjacent segmental charge portions and this arrangement provides two additional advantages: In the known warhead embodiment due to the use of an exploding decomposition charge for separating the breaking seams, it frequently happens that the adjacent breaking seams are opened at places where no separation is desired. This is, of course, disadvantageous particularly due to the result in decrease of the desired symmetrical spreading of the explosive bodies. This phenomenon is entirely prevented in the present invention due to the arrangement of the breaking seams adjacent the juncture of two adjacent explosive bodies or explosive body segments. The further advantage is that the required separation work for this separation of the breaking seams, which start at one or both ends of the individual explosive body layers or segments, and which progresses from there, is much smaller than the work required to cause separation which is initiated in a central section of the individual explosive body assemblies. It is simplier to start the separation in an end portion than it is in a central portion. In the inventive warhead the separation of the outer supporting warhead jacket and the uniform parts is accomplished by the provision of the breaking seams which cause the separation in a predetermined manner. The prior art warhead construction requires a decomposition charge which is unsuitable for causing the same effect. In the inventive arrangement, the separation is initiated by accurately aimed pressure gas which is produced by ignition of ejection cartridges.

In one embodiment of the invention, each explosive body charge assembly is associated with an ejection cartridge which is situated in the end range of the associated assembly. The ejection cartridge is advantageously ignited at the end which is adjacent to the corresponding explosive body ends. The ignition of the cartridge thus causes pressure forces due to the building up of gas pressure which act first on the explosive body ends which are adjacent to the cartridge and thereafter, with the progressive burning of the ejection cartridge, act on the remaining explosive body portions. These pressure forces also effect the breaking of the seams and it takes place progressively from one end to the other so that the freeing of the individual charge bodies proceeds progressively, for example, from the front end of the missile toward the rear, so that they separate and move outwardly in a uniform manner from the front end toward the rear.

Several assemblies of the explosive charge portions or segments are arranged one behind the other in an axial direction and a complete separation of all of the breaking seams is effected progressively for example, from the front of the warhead toward the rear. The explosive body elements with progressive separation of the breaking seams perform, within the jacket section surrounding the bodies in a form fitting manner, uniform radially outwardly directed tilting movements about their ends which are remote from the ejection cartridge under the influence of the pressure forces which are generated by the burning of the ejection cartridges. The explosive bodies can perform these tilting movements even in the event that there is a tight or close sequence of explosive body layers in the assembly and they will perform this movement without obstruction.

In the preferred arrangement, at least two separate assemblies of explosive charge elements are arranged one behind the other and around a central tube, and the individual explosive charge portions are advantageously of segmental form. The central tube is provided with an ejection cartridge adjacent preferably the forward end of each assembly. Each cartridge is ignited progressively so that the outward movement of the individual segmental portions progresses from the front toward the rear of the warhead. The ejection cartridges are advantageously fixed by means of spacer tubes at the center of the individual assemblies and the burning of the foremost ejection cartridge subsequently provides for an ignition of the one thereafter and so on.

Accordingly, it is an object of the invention to provide an improved warhead constructon which includes at least one assembly of explosive charges comprising a plurality of individual charge elements arranged around a central ejection cartridge and wherein there is an exterior jacket having a plurality of longitudinally extending breaking seams located round the circumference and advantageously located around the circumference and overlying the junction between adjacent charge portions, the ejection charge producing a gas pressure centrally of the charge portions and effecting the breaking of the outer wall along the breaking seams to cause a progressive outward movement of the individual charge portions.

A further object of the invention is to provide a warhead for a device such as a missile which includes a plurality of axially spaced assemblies of explosive charges each assembly including a plurality of charges arranged around a central area and around an ignition device such as an ejection cartridge and all located within a casing having longitudinally extending seams or weakened areas which are arranged to break out to permit a symmetrical spreading of the individual explosive charges.

A further object of the invention is to provide a warhead which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described an embodiment of the invention.

BRIEF DESCRIPTION OF THE DRAWINGS

In the drawings:

FIG. 1 is a partial elevational and partial sectional view of a warhead constructed in accordance with the invention; and FIG. 2 is a section taken on the line II—II of FIG. 1.

GENERAL DESCRIPTION OF THE PREFERRED EMBODIMENT

Referring to the drawings in particular, the invention embodied therein comprises a warhead generally designated 1 which, for example, may be incorporated on a missile body 50 and which includes an outer supporting jacket or casing 2. A hood 5 is arranged at the forward or front end of the warhead and a time igniter 6 is formed as the forwardly projecting tip. A bottom piece or warhead end closure 7 is located at the trailing or rear end.

In accordance with the invention, the outer supporting jacket 2 is provided with four longitudinally extending breaking seams or weakened areas 8 which are uniformly distributed around the circumference of the jacket 2 and which extend parallel to its central longitudinal axis. The jacket 2 surrounds two explosive-body or explosive-charge assemblies generally designated **11*a* and 11*b* which are arranged in axially spaced locations and which are supported on an intermediate plate 10 and the bottom piece 7 respectively. The plate 10 is provided with a central bore in alignment with a central hollow space 18*a* to facilitate the interfitting of one or more spacer pipes 26 which extend centrally along the length occupied by the two charge assemblies 11*a* and 11*b***.

In accordance with a feature of the invention, each assembly **11*a* and 11*b* includes a plurality of separate explosive body portions or segments of explosive charges 12*a*, for the assembly 11*a*, and 12*b*, for the assembly 11*b*. The body portions 12*a* and 12*b* are of circular segmental shape cross section and they include radial areas on each side which abut at adjacent segments. The individual segments are arranged such that their radial separation lines fall in alignment with the longitudinally extending breaking seams 8**.

The individual segments **12*a* and 12*b* each include forward ends 13*a* and 13*b*, respectively, which are conically hollowed at the forward end face. Their opposite ends 14a and 14*b* respectively are flattened so that they can be accommodated on the plate 10 and the bottom piece 7, respectively. The individual explosive bodies 12*a* and 12*b* may be, for example, ground mines which are provided with individual impact ignition arrangement which are responsive to impact on all sides. For this purpose, each would have a longitudinal bore 15** for receiving their ignition devices (not shown).

Due to the circular segmental shaped construction of the individual explosive body sectors **12*a* and 12*b* each of the assemblies 11*a* and 11*b* embrance respective hollow space areas 18*a* and 18*b*. A gas producing ejection cartridge 19*a* and 19*b* are located in the respective spaces 18*a* and 18*b*. The arrangement is such that a hollow space cavity section 21*a* and 21*b* remains between the ejection cartridge 19*a*, 19*b* and the end 20*a* and 20*b*, respectively, of the associated explosive body assemblies 11a and 11*b*. The forward cavity 21*a* which faces the hood 5 is substantially shorter than the hollow spacer cavity section 23*a* or 23*b* which remains between the ejection cartridges 19*a* and 19*b* and the end 22*a* and 22*b* of the associated explosive body layer 11*a* and 11*b***, respectively.

The ejection cartridges 19*a* and 19*b* are secured against turning or twisting in the central hollow spaces 18*a* and 18*b* respectively. The cartridges 19*a* and 19*b* are held in their fixed spaced relationship by the spacer pipes 26, which also provide gas conduits for the combustion gas conduits for the combustion gases which are generated by the ignition of the ejection cartridges. The ejection cartridges 19*a* and 19*b* are ignited one after the other. The first ejection cartridge 19*a* is ignited by the time-ignition means 6 which is in operative connection with the cartridge by lines (not shown). Ignition takes place at the end of the cartridge 19*a* which faces the hood 5. Thereafter the other ejection cartridge 19*b* is ignited by the combustion gases which are generated upon burning of the first ignited cartridge 19*a*. The gases move through the spacer pipes 26 and reach the end face of the cartridge 19*b* at the end which faces the hood 5. The consequence is that the separation of all the breaking seams 8 caused by the pressure of the combustion gases of the ejection cartridges 19*a* and 19*b* progresses from the front end 3 of the warhead jacket 2 and proceeds uniformly until the rear end 4 of the warhead jacket 2. The explosive body segments 12*a* which are at the end adjacent the hood 5 are first to perform uniform tilting movements about their unsecured ends which are adjacent the plate 10. As soon as the breaking seams 8 are separated the explosive body segments 12*a* are symmetrically spread. Subsequently, this phenomenon is repeated in respect to the explosive charge segments 12*b* of the assembly 11*b*.

What is claimed is:

1. A warhead construction comprising an outer tubular jacket for said warhead, at least one assembly of a plurality of longitudinally extending and substantially coextensive circumferentially arranged explosive charges in said jacket adjacent the interior wall of said jacket and defining a longitudinally extending hollow space at the center of said charges, and an ejection cartridge located within said hollow space adjacent one end of said charges, said jacket having a plurality of circumferentially spaced breaking seams extending longitudinally along the length thereof and overlying said assembly in a position to break from the ejection cartridge end toward the opposite wall upon ignition of said cartridge to permit the spreading out of said charges, said ejection cartridge producing pressure forces which act first upon the ends of said explosive charges which are adjacent to said cartridge and which thereafter, upon pressure burning of said explosive charges in a progressive manner toward the opposite ends thereof, cause progressive and uniform separation and breaking away of said jacket along said breaking seams toward the opposite end.

2. A warhead construction, according to claim 1, wherein there are a plurality of axially spaced assemblies in said jacket each assembly including a cartridge within said hollow space, said seams breaking progressively from one end.

3. A warhead construction, according to claim 1, wherein said breaking seams extend parallel to the central longitudinal axis of said jacket.

4. A warhead construction, according to claim 1, including a plurality of assemblies of explosive charges arranged in axially spaced locations within said jacket, a cartridge located within each of the hollow spaces with each of said assemblies, said cartridges of each assembly being located so that the exposed end face of one is ignited by the burning of the end face of the other.

5. A warhead construction, according to claim 1, wherein each of said cartridges are located adjacent the forward ends of their associated assemblies, the cartridges being spaced apart by an amount such that the first in line will be able to light the second in line upon approaching its terminal phase of burning.

6. A warhead construction, according to claim 5, including ignition means associated with said first in line cartridge, said first in line cartridge being at the forward ends of said missile and being ignited by said ignition means and being affected to ignite the second in line cartridge upon approaching the completion of its burning.

7. A warhead construction, according to claim 5, wherein said individual ejection cartridges are affixed in said hollow space at axialy spaced location by axially arranged spacer pipes.

8. A warhead construction, according to claim 7, wherein said spacer pipes also define gas conduits for the flow of pressure gas from said cartridges after ignition thereof.

9. A warhead construction, according to claim 1, wherein there are a plurality of assemblies of said charges arranged in axially spaced locations, each of said assemblies including individual charge bodies which form a hollow front end portion.

10. A warhead construction, comprising an elongated tubular outer jacket, a plurality of axially spaced assemblies within said jacket, each assembly including a plurality of longitudinally extending and substantially coextensive circumferentially arranged explosive charges located within said jacket adjacent the interior wall thereof and being constructed to define a longitudinally extending hollow space at the center of said assembly, said charges being of segmental circular form and abutting with the next adjacent charge portion along a radial contact line, an explosive ejection charge located centrally within each of said assemblies adjacent one end thereof, said jacket having a plurality of uniformly cirumferentially spaced breaking seams extending longitudinally along the length thereof and overlying said assembly in a position to break open from the ejection charge toward the opposite end upon ignition of said cartridge to permit the spreading out of said charges, said ejection cartridge producing pressure forces which act first upon the ends of said explosive charges which are adjacent to said cartridge and which thereafter, upon pressure burning of said explosive charges in a progressive manner toward the opposite ends thereof, cause progressive and uniform separation and breaking away of said jacket along said breaking seams toward the opposite end.

11. A warhead construction, according to claim 10, wherein said charge portions comprise ground mines.

12. A warhead construction, according to claim 10, wherein said jacket break seams overlie the radially extending separation line between adjacent charge portions.

* * * * *